United States Patent [19]

Carpenter

[11] Patent Number: 4,823,431

[45] Date of Patent: Apr. 25, 1989

[54] FAN BLADE CLEANING DEVICE

[76] Inventor: Weda B. Carpenter, Rt. 2, Box 907 R, Fort Worth, Tex. 76135

[21] Appl. No.: 55,833

[22] Filed: Jun. 1, 1987

[51] Int. Cl.[4] ..... A47L 9/06

[52] U.S. Cl. ..... 15/394; 15/210 A; 15/235; 15/398

[58] Field of Search ..... 15/210 R, 210 A, 229 AC, 15/394, 235, 229 BC, 160

[56] References Cited

U.S. PATENT DOCUMENTS

| | | | |
|---|---|---|---|
| 2,276,264 | 3/1942 | Goldfinger | 15/210 A |
| 2,277,444 | 3/1942 | McPhee | 15/394 X |
| 2,639,454 | 5/1953 | Dory | 15/145 X |
| 2,697,642 | 12/1954 | Rudy | 15/145 X |
| 3,110,923 | 11/1963 | Berleme | 15/394 |
| 3,381,334 | 5/1968 | Redmond | 15/229 AC |
| 3,653,425 | 4/1972 | Elliott et al. | 15/394 X |
| 3,989,388 | 11/1976 | Sparr | 15/160 X |

*Primary Examiner*—Chris K. Moore
*Attorney, Agent, or Firm*—Richard C. Litman

[57] ABSTRACT

A portable ceiling fan blade cleaning device, consisting of a solid frame configured to form an elongated orifice with one terminal end of the frame downwardly extending to juncture with a device extension. A second terminal end of the frame allows a cleaning cloth to be disposed onto the frame such that as the ceiling fan blades slides traversely through the elongated orifice of the frame, the environmental surfaces of the ceiling fan blade are cleaned by the surface application of the cleaning cloth to the surfaces of the ceiling fan blade.

1 Claim, 2 Drawing Sheets

FAN BLADE CLEANING DEVICE

BACKGROUND OF INVENTION

1. Field of Invention

Cleaning devices of many shapes and sizes have been created for handling a variety of needs. Currently, there are no devices that allow a user to clean ceiling fan blades without the use of a ladder, step stool, or other elevating device. Brooms, mops, and handled devices grant the user safe access to the lower portion of the fan blade. In order to clean the tops of these blades, the user must resort to the potential hazards of using elevating devices and apparatuses.

The present invention relates to cleaning devices and, more specifically, to a device that allows a user to clean both the top and bottom of a ceiling fan blade without the need for an elevating device of any kind. The invention may be adapted to work with a wide variety of blade types, shapes, and sizes. Additionally, this invention will not damage the blade, its finish, or fan mechanism in any way.

2. Description of Prior Art

Various prior art cleaning devices and the like, as well as the apparatuses and the methods of their construction in general, are known and found to be exemplary of the U.S. prior art.

U.S. Pat. No. 2,490,892 to Westhoff, U.S. Pat. No. 2,599,420 to Westhoff and Williams, and U.S. Pat. No. 3,520,018 to Zaidan, each disclose a device for cleaning venetian blinds and the like, using forked devices over which a plurality of tubular cleaning surfaces are placed.

Specifically, the Westhoff patent, while providing a method for adapting a source of vacuum power to the cleaning surface, lacks a sufficient mechanism for securing said ceiling fan blades, which are prone to rotate around a central hub if pushed.

Further, the second Westhoff U.S. Pat. No. 2,590,420 possesses no method for easily and conveniently engaging ceiling fan blades as the bristles are contained within a central passage between parallel branches of a tubular member.

Zaidan, in U.S. Pat. No. 3,520,018, discloses a bifurcated structure, providing arms possessing inwardly projecting bristles. In Westhoff, et al., the central channel, with inwardly facing bristles, provides an identical result; that is, no convenient method for cleaning a ceiling fan blade.

U.S. Pat. No. 2,658,221 to Nicoli discloses no method for connecting a vacuum attachment, for reaching ceiling fan blades, or for cleaning fan blades without resorting to holding ceiling fan blades by hand or by other devices.

Goguen, in U.S. Pat. No. 2,663,046, provides a method for cleaning a plurality of substantially flat surfaces simultaneously, but lacks adaptability for the safe and convenient cleaning of ceiling fan blades.

Delacretaz's invention, disclosed in U.S. Pat. No. 2,856,625, lacks adaption to suction devices and further requires an elevated apparatus for cleaning ceiling fan blades. It further lacks adaption for convenient cleaning of said ceiling fan blades.

Likewise, Dunn, U.S. Pat. No. 843,590; Hillis, U.S. Pat. No. 4,502,175; and Becker, U.S. Pat. No. 1,766,870, disclose no apparatus for the safe or practical cleaning of elevated, pivotably-mounted, ceiling fan blades.

None of the prior art, either singly or in combination, discloses the novel construction of the present invention; the features of the present invention provide for the safe and convenient cleaning of ceiling fan blades.

SUMMARY OF THE INVENTION

It is the purpose and objective of the present invention to provide an improved means for safely cleaning both the tops and bottoms of ceiling fan blades without the need for ladders, step stools, or other elevating devices.

It is a further objective of the present invention to provide a cleaning device for ceiling blades that will not, in any way, damage the blade, its finish, or fan mechanism through normal use.

It is yet another feature and objective of the present invention to provide a one-piece cleaning cover that is easily installed for cleaning or removed for replacement.

Yet another purpose and objective of the present invention is to provide a vacuum attachment, independent of the manual cleaning device, to be used in the cleaning of ceiling fan blades.

DESCRIPTION OF THE PREFERRED EMBODIMENT OF THE INVENTION

Figure 1:
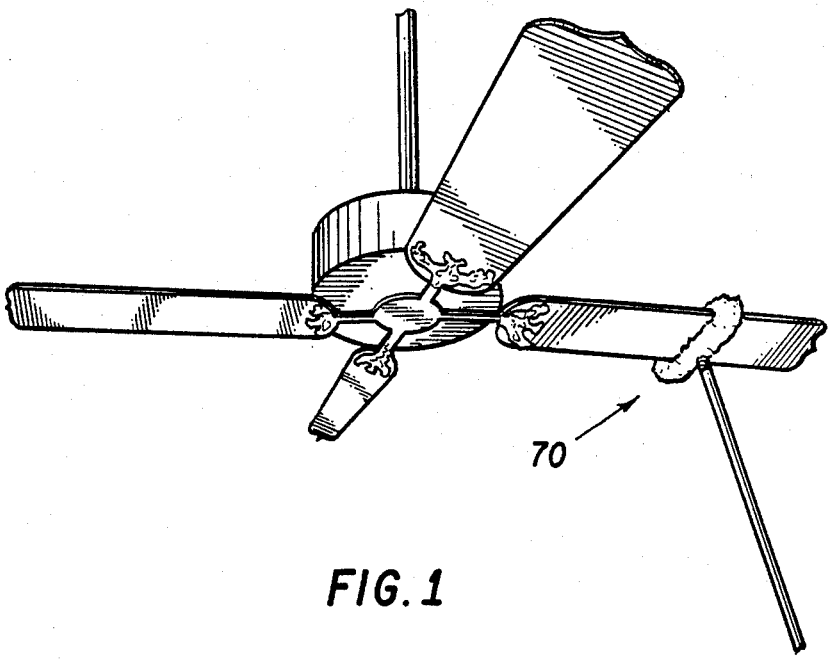
FIG. 1 is an isometric view, showing the device in use and illustrating how the device slides along the upper surface, along the length of the ceiling fan blade, as well as the lower surface.
Figure 2:
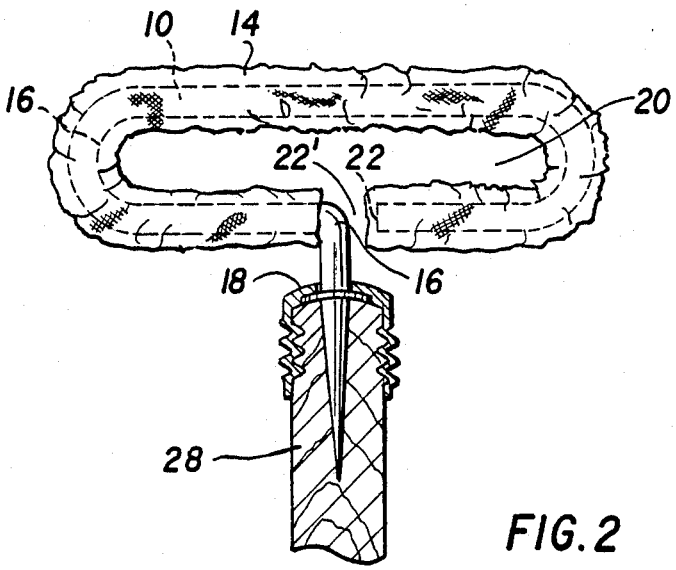
FIG. 2 is a view of the device with an extension handle, illustrating the basic structure of the device.
Figure 3:
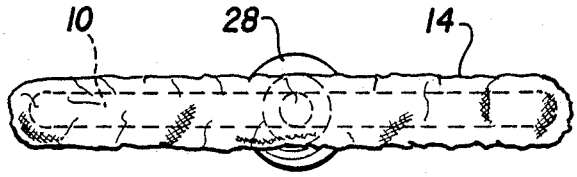
FIG. 3 is a top view of the fan blade cleaning device.

Referring now to FIGS. 1 through 3, there is shown in FIG. 1 an isometric view of the preferred embodiment of a fan blade cleaning device 70. Cleaning device 70 comprises an elongated solid frame element 10 covered with a cleaning material and affixed to a handle extension, 28.

FIG. 2 is a front view of cleaning device 70. Frame 10 is configured as an open loop as shown to form orifice 20, through which a ceiling fan blade may slide in the cleaning process. Frame 10 having terminal end 22 which ends or terminates at a point short of bend 16 such that a slot or opening 22' is formed thereby, thus allowing a cleaning material 14 to be affixed onto frame 10. A variety of terry-cloth or other suitable cleaning materials, such as lambswool, may be slipped onto frame 10 to aid in the cleaning application; cleaning material 14 being disposed over frame 10 such that frame 10 is enclosed thereby with cleaning material 14.

Device 70, being capable of sliding over a ceiling fan blade with the aid of extension 28, not only cleans the upper, lower, and edge surfaces of the ceiling fan blade, but also serves to prevent the ceiling fan blade from rotating, as the blade is securely contained within the device. This apparatus thus eliminates the need for elevating devices, such as ladders and step stools, to clean the ceiling fan blades.

Figure 4:
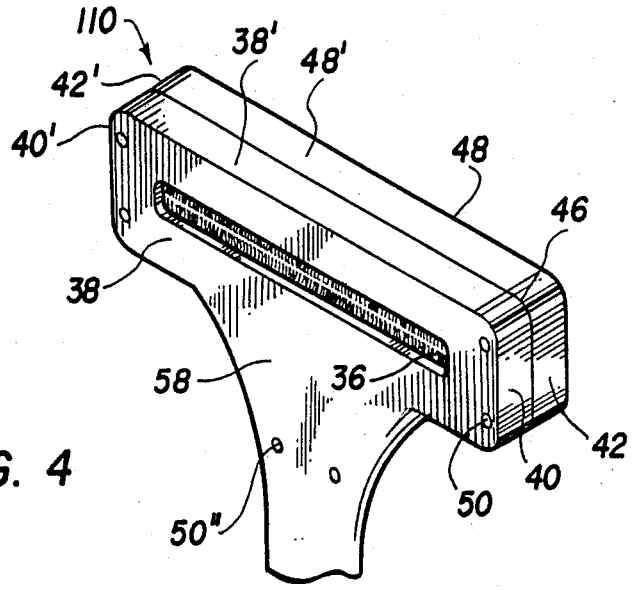
FIG. 4 is a perspective view, showing a vacuum attachment used also for cleaning ceiling fan blades.
Figure 5:
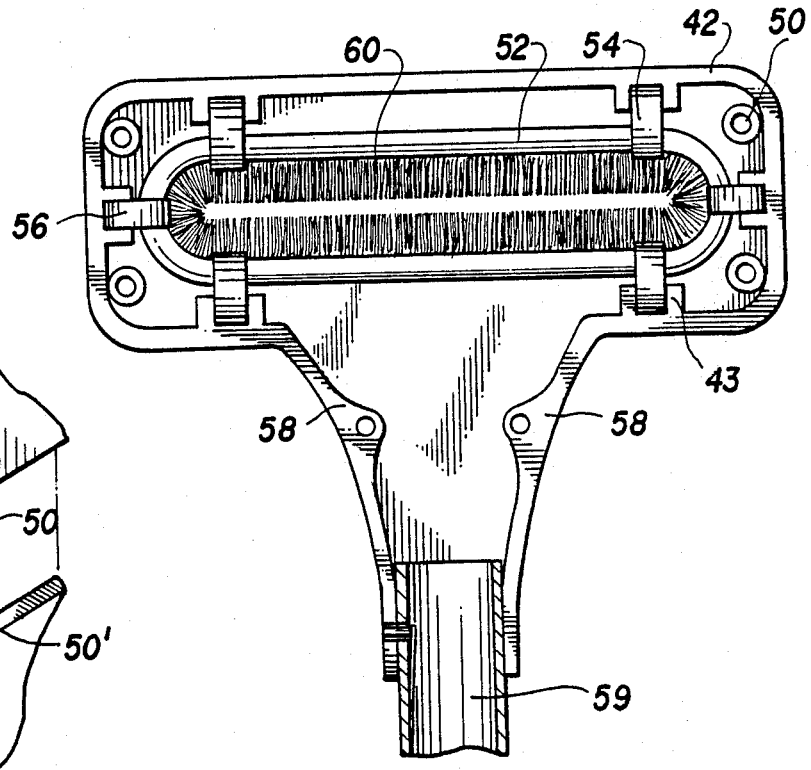
FIG. 5 is a sectional view, showing interior detail of the vacuum attachment.
Figure 6:
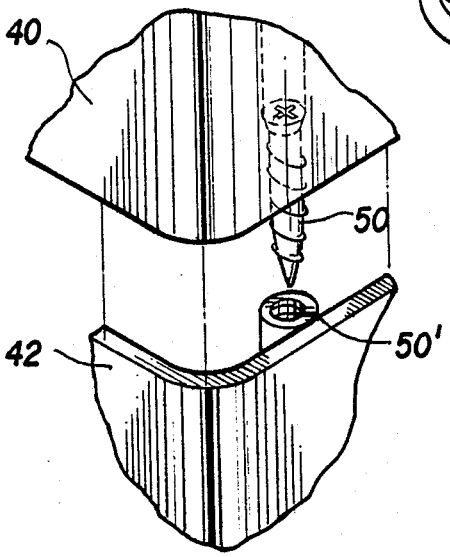
FIG. 6 is a drawing, showing fastener details.
Figure 7:
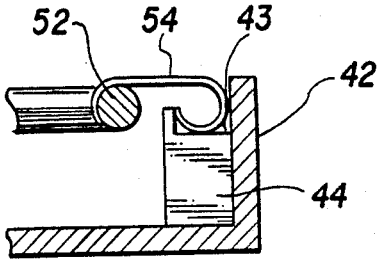
FIG. 7 shows assembly detail of the vacuum attachment fan blade cleaner.

Device 110, as illustrated in FIGS. 4 through 7, is a alternative embodiment. Referring now to FIGS. 4 thorugh 7, device 110 consists of a molded body manufactured of any suitable material, such as plastic or metal, having a planar frontal surface 38, a rear planar surface 48, upper planar surfaces 38' and 48', and planar surface 40 which is laterally disposed to both upper and frontal planar surfaces 38 and 38'. Planar lateral surface 42 being disposed to rear planar surface 48 and upper planar surface 48'.

Planar frontal surface 38, upper planar surface 38' and planar lateral surfaces 40 and 40' are rigidly affixed, forming thereby a front housing vacuum assembly. Planar rear surface 48 and its associated planar surfaces 48', 42, and 42' form a rear housing vacuum assembly whereby each assembly may be separated one from the other.

First or front, and second or rear, vacuum housing assemblies extend downwardly, flaring into vacuum extension adaptor 58, in which each section is further secured by fastening means 50'.

Removal of fastening means 50 enables the frontal planar surface 48 and it's associated surfaces 38', 40, and 40' to be disassembled or separated from the other assembly along the line of disengagement 46. Line of disengagement 46 forms a boundary to the first and second assemblies.

Frontal planar surface 38 and rear planar surface 48 have an elongated orifice or passageway 36, disposed longitudinally therein such that a ceiling fan blade may project therethrough. The ceiling fan blade extends transversely through the device 110, entering orifice 36 at the frontal or rear planar surfaces and exiting at the other relative surface orifice.

Frame element 52 has fastening means 54 by which frame 52 is inserted into an assembly. Frame 52, which is being held by spring clip 54 and seated in concaval recess 43, is disposed of within assembly reinforcement material 44.

Frame element 52 an opposed element 52' has cleaning bristles 60 and opposed bristles 60' radially disposed about the peripheral inner or inwardly disposed edge of frame element 52 to form a space 36 such that as a ceiling fan blade extends transversely through the molded vacuum body, the radially disposed terminal ends of cleaning bristles 60 come into proximate contact with the surfaces of a ceiling fan blade.

Front and rear vacuum housing assemblies extend downward through transition member 53 to terminal end 80 into which a vacuum extension 59 may be inserted.

Transition member 53 flares outward from terminal end 80 enclosing thereby air chamber 53' and in conjunction with molded vacuum body 110 encloses air chamber 53, which is disposed peripherally to said elongated frame element 52 such that negative air pressure may be drawn through extension 59, the negative air pressure or suction being distributed about the periphery of said englongated frame element 52 such that surfaces of a ceiling fan blade are substantively exposed to the effects of this negative air pressure.

It can be seen from the foregoing figures that each of the objectives of the invention has been satisfied. Further, it will be readily apparent that many small changes may occur to those skilled in the relevant art and, therefore the scope of invention is limited only by the claims.

What is claimed is:

1. A portable vacuum attachment device for cleaning ceiling fan blades comprising:

a molded front housing assembly, a molded rear housing assembly, said front housing assembly and rear housing assembly having fastening means for the mutual attachment thereof, said front and rear housing assemblies forming a molded vacuum assembly defining an air chamber therein, a frame element in the form of a closed loop having inwardly disposed cleaning bristles mounted within said air chamber and forming a passageway for the insertion of ceiling fan blades for contact with said bristles for the cleaning of said blades, said front and rear housing assemblies provided with an elongated orifice adjacent said closed loop passageway, and said vacuum assembly terminating at an inlet end element communicating with said air chamber and adapted to be joined to a source of vacuum.

* * * * *